US007079788B2

(12) United States Patent
Ban et al.

(10) Patent No.: US 7,079,788 B2
(45) Date of Patent: Jul. 18, 2006

(54) DEVELOPER CARTRIDGE AND IMAGE FORMING APPARATUS

(75) Inventors: Yutaka Ban, Tokyo (JP); Yusuke Yamada, Ibaraki-ken (JP); Fumio Tazawa, Abiko (JP); Hironori Minagawa, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 10/028,668

(22) Filed: Dec. 28, 2001

(65) Prior Publication Data

US 2002/0106215 A1 Aug. 8, 2002

(30) Foreign Application Priority Data

Dec. 28, 2000 (JP) ..... 2000-401704

(51) Int. Cl.
*G03G 15/08* (2006.01)

(52) U.S. Cl. ..... 399/120; 399/262

(58) Field of Classification Search ..... 399/106, 399/119, 120, 262, 263, 261, 360; 222/DIG. 1
See application file for complete search history.

(56) References Cited

U.S. PATENT DOCUMENTS

| | | | | | |
|---|---|---|---|---|---|
| 4,981,218 | A | | 1/1991 | Ban et al. | 206/633 |
| 5,020,697 | A | * | 6/1991 | Koiso et al. | 222/DIG. 1 |
| 5,268,722 | A | | 12/1993 | Ikkatai et al. | 355/260 |
| 5,351,728 | A | | 10/1994 | Ban et al. | 141/364 |
| 5,508,794 | A | * | 4/1996 | Ikesue et al. | 399/120 |
| 5,513,679 | A | | 5/1996 | Yamada | 141/364 |
| 5,598,254 | A | * | 1/1997 | Ikesue et al. | 222/DIG. 1 |
| 5,870,652 | A | | 2/1999 | Kanamori et al. | 399/106 |
| 6,125,243 | A | * | 9/2000 | Shoji et al. | |
| 6,131,008 | A | | 10/2000 | Kanamori et al. | 399/263 |
| 6,289,193 | B1 | | 9/2001 | Ban et al. | 399/258 |
| 6,292,644 | B1 | | 9/2001 | Goto et al. | 399/262 |
| 6,314,261 | B1 | | 11/2001 | Omata et al. | 399/258 |
| 6,370,349 | B1 | * | 4/2002 | Tsuji et al. | 222/DIG. 1 |

FOREIGN PATENT DOCUMENTS

| | | | |
|---|---|---|---|
| JP | 2-6978 | | 1/1990 |
| JP | 2-244174 | | 9/1990 |
| JP | 04001690 A | * | 1/1992 |
| JP | 7-20705 | | 1/1995 |
| JP | 9-269643 | | 10/1997 |
| JP | 11-174840 | | 7/1999 |

OTHER PUBLICATIONS

Patent Abstracts of Japan, Publication No. 9–292764, Nov. 11, 1997.
Patent Abstracts of Japan, Publication No. 2000–122243, Apr. 28, 2000.
Patent Abstracts of Japan, Publication No. 8–314258, Nov. 29, 1996.
Patent Abstracts of Japan, Publication No. 2–244174, Sep. 28, 1990.

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

A cartridge is detachably mountable to an image forming apparatus and includes a first container, which contains a developer to be supplied into the image forming apparatus and a second container, which is rotatable to feed the developer toward the discharge opening. A developer discharge opening is provided at one longitudinal end of the first container. The second container accommodates a developer collected from the image forming apparatus. The first container is rotatably supported, at the other longitudinal end thereof, by the second container, which is unrotatably engageable with the image bearing member.

18 Claims, 9 Drawing Sheets

DEVELOPER CARTRIDGE AND IMAGE FORMING APPARATUS

FIELD OF THE INVENTION AND RELATED ART

The present invention relates to an image forming apparatus which employs an electrophotographic recording method or an electrostatic recording method. In particular, it relates to a developer container for supplying developer to an Image forming apparatus such as a copying machine, a printer, a facsimile machine, and the like.

Toner in the form of microscopic powder has long been used as the developer for an image forming apparatus, for example, an electrophotographic copying machine, a printer, or the like. It has also been a common practice that as the developer in the main assembly of such an image forming apparatus is consumed, toner is supplied to such an image forming apparatus, with the use of a toner supply container.

Since toner is in the form of microscopic powder, there has been a problem that toner scatters, contaminating an operator, and/or the surrounding area of an image forming apparatus, during an operation for supplying the image forming apparatus with toner. Therefore, a few methods for solving this problem have been proposed, and some of them have been put to practical use. According to these methods, a toner supply container is placed inside the main assembly of an image forming apparatus, and a small amount of toner is discharged as necessary from the small opening of the toner supply container.

Japanese Laid-open Patent Application 7-20705 discloses a toner supply container compatible with the above described toner supplying method. This toner supply container is approximately in the form of a cylindrical bottle. It has a small toner outlet, which is located approximately in the center of one of the lengthwise end walls. The internal surface of its cylindrical main portion is provided with a spiral rib, which conveys the toner to the adjacencies of the toner outlet. Upon arriving at the adjacencies of the toner outlet, the toner is guided to the toner outlet, by a toner ejecting portion which is at the end of the toner supply container.

On the other hand, in an electrophotographic image forming apparatus, the toner particles are removed from the photoconductive drum by the cleaning means, and the removed toner particles must be removed from the image forming apparatus. In the cases of some of the image forming apparatuses using a two component developing method, the developer which contains a predetermined amount of toner is supplied to the developing device, while recovering the deteriorated developer from the developing device, and removing the recovered developer from the image forming apparatus.

More specifically, the toner removed from the photoconductive drum, the deteriorated developer recovered from the developing device, or the like, is temporarily stored in a recovered developer storage container in the image forming apparatus, and as the amount of the recovered developer in the developer storage container reaches a predetermined level, the recovered developer in the developer storage container is removed from the image forming apparatus. This removal of the recovered developer requires the time and work of an operator in addition to the time and work of the operator for supplying the image forming apparatus with toner. Thus, a few methods for eliminating this time and work for removing the recovered developer have been proposed. According to these methods, the recovered developer storage container is formed as an integral part of the toner supply container, so that as the toner supply container is placed in the image forming apparatus to supply the image forming apparatus with developer, the removed developer container is inevitably placed in the image forming apparatus, and as the toner supply container is removed from the image forming apparatus as it becomes empty, the removed developer container is inevitably removed from the image forming apparatus. In other words, the recovered developer is inevitably removed from the image forming apparatus as an empty toner supply container is replaced with a fresh one.

For example, Japanese Laid-open Patent Application 2-244174 or 2-6978 discloses, for example, a toner supply container integrally comprising a removed toner container, whereas Japanese Laid-open Patent Application 11-174840 discloses a toner supply container integrally comprising a removed developer container. Also, Japanese Laid-open Patent Application 9-269643 discloses a recovered toner container. This recovered toner container is cylindrical, and is integrally attached to one of the lengthwise ends of a toner supply container, such as the above described one, which conveys the toner therein by being rotated. It is attached to the toner supply container so that its rotational axis coincides with that of the toner supply container. It receives the recovered toner as it is rotated with the toner supply container.

However, the removed toner containers, or removed developer containers, such as those described above suffered from the following problems.

It has been a common practice that a toner supply container such as the one disclosed in Laid-open Patent Application 7-20705, which discharges toner by being rotated, is structured to receive the force by which it is rotationally driven, through one of its lengthwise ends, that is, the ends in terms of its axial direction. This is for the following reason: such a practice makes it possible to simplify the image forming apparatus structure, on the side from which the driving force is transmitted to the toner supply container, and therefore, making it possible to reduce the space necessary for that structure.

However, there is a tendency that as the driving force is transmitted to one of the lengthwise ends of the toner supply container, the other end of the container wobbles as it rotates, hitting the inwardly facing surfaces of the toner supply container chamber within the image forming apparatus, generating therefore periodic noises and/or impacts.

It is possible that these periodic noises and/or impacts will result in the formation of an inferior image, in particular, an image with abnormal pitch or the like, and in fact, this has occurred. Further, by the time the entirety of the toner in the toner supply container is exhausted, a toner supply container is rotated a substantial number of times. Therefore, the external surface of the toner supply container will be covered with a substantial number of scars caused by the banging and scratching resulting from the aforementioned wobbly rotation of one of the lengthwise ends of the toner supply container, and in fact, this has been the case. This has created a problem that a recycled toner supply container appears unsightly.

As for means for dealing with the above described problem, it is possible to support a rotational toner supply container with the use of bearings or rollers to control the toner supply container in terms of rotational axis. This type of method, however, has resulted in new problems. That is, not only has it increased the manufacturing cost of the main assembly of an image forming apparatus, but also it has substantially increased the space necessary for the toner supply container, in the image forming apparatus, adversely affecting the effort for making the image forming apparatus compact.

As for means for preventing the external surface of a toner supply container from suffering from superficial damages, it is possible to paste a patch of protective film to the container across the areas which are likely to be damaged, or to wrap the container with shrinkable film (thermally shrinkable film), across the areas which are likely to be damaged. This, however, increases the toner supply container manufacture cost, and also requires the protective film patches or shrinkable film to be removed when remanufacturing the toner supply container, which is undesirable.

The magnitude of the rotational wobbling of a toner supply container is somewhat proportional to the capacity of the toner supply container. In particular, it is closely related to the ratio of the length of the toner supply container relative to the diameter of the toner supply container; the greater the ratio, the more likely is the toner supply container to wobble. Further, as the toner remaining in the toner supply container reduces, the wobbling of the toner supply container becomes more conspicuous. In other words, the wobbling of the toner supply container is more conspicuous when the inertial moment of the toner supply container is relatively small. This tendency is exacerbated, for the following reason, when the aforementioned toner outlet of the toner supply container is on the side from which the toner supply container is driven. That is, the toner in the toner supply container is conveyed to the adjacencies of the toner outlet, by the toner conveying member. Therefore, after the amount of the toner remaining in the toner supply container becomes small enough to affect the inertial moment of the toner supply container, the major portion of the toner in the toner supply container will be in the adjacencies of the toner outlet, worsening the problem. As for the relationship between this problem and the rotational speed of the toner supply container, when the rotational speed of the toner supply container is no more than 10 rpm, the rotational wobbling of the toner supply container is negligible. However, when the toner supply container is rotated at a relatively high speed, that is, when the rotational speed of the toner supply container is no less than 10 rpm, in particular, when it is no less than 30 rpm, the wobbling is likely to become a problem.

SUMMARY OF THE INVENTION

Thus, the primary object of the present invention is to provide a developer container in which the rotational wobbling of the first storage portion of the developer container is prevented by the second storage portion of the developer container.

These and other objects, features, and advantages of the present invention will become more apparent upon consideration of the following description of the preferred embodiments of the present invention, taken in conjunction with the accompanying drawings

DESCRIPTION OF THE PREFERRED EMBODIMENTS (Embodiment 1)

Figure 1A:
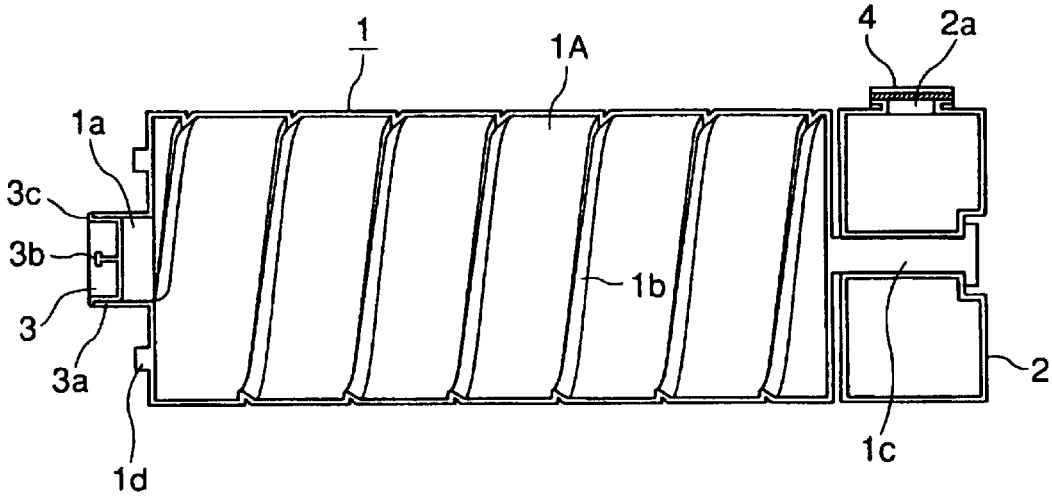
FIG. 1(*a*) is a vertical sectional view of the toner supply container in the first embodiment of the present invention, at the vertical plane which includes the axial line of the toner supply container, and FIG. 1(*b*) is a vertical sectional view of a portion of the recovered developer component storage portion, in the first embodiment of the present invention, at a vertical plane which includes the axial line of the recovered developer component storage portion.
Figure 1B:
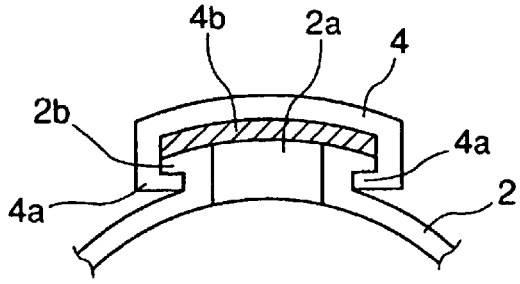
Figure 2:
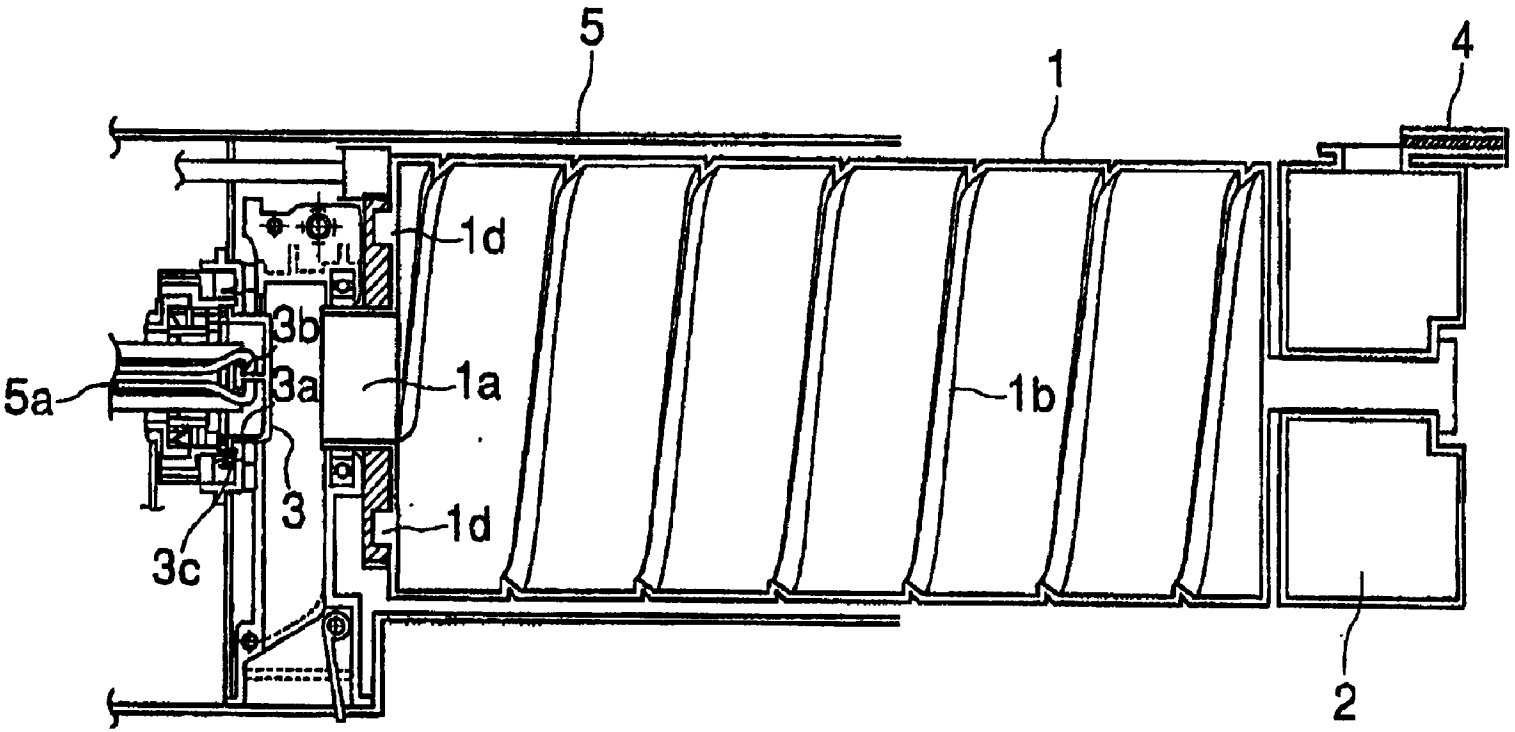
FIG. 2 is a vertical sectional view of the toner supply container in the first embodiment of the present invention, which is in the proper position within the image assembly of an image forming apparatus.

The first embodiment of the present invention will be described with reference to the appended drawings. FIG. 1(*a*) is a sectional view of the toner supply container as a developer container, in the first embodiment of the present invention, and FIG. 2 is a sectional view of the toner supply container in accordance with the present invention which is in the proper toner supply container position in the main assembly of an image forming apparatus.

In FIGS. 1(*a*) and 2, a referential code 1 designates a toner storage portion as a first storage portion, and a referential code 2 designates a recovered developer component storage portion as a second storage portion. A referential code 3 designates a sealing member, and a referential code 4 designates a shutter of the recovered developer component storage portion.

{Toner Storage Portion}

Referring to FIG. 1(*a*), designated by the referential code 1 is the toner storage portion, which has a toner outlet 1*a* for discharging the toner. The toner discharging outlet 1*a* is at one end of the toner storage portion in terms of the axial direction of the toner storage portion, and remains sealed with the sealing member 3, which is opened or closed as necessary. The length of the toner storage portion 1 is no less than 1.5 times the diameter of the toner storage portion 1, and is no more than 6 times the diameter of the toner storage portion. The rotational axis of the toner storage portion 1 coincides with the axial line of the cylindrical portion of the toner storage portion 1, and is approximately parallel to the lengthwise direction of the toner storage portion, and the direction in which the toner is conveyed within the toner storage portion. The toner discharge outlet 1*a* is approximately circular in the cross section perpendicular to its axial line, and the axial line of the other discharge outlet 1*a* coincides with the rotational axis of the toner storage portion 1.

The toner supply container main structure 1A, which constitutes the toner storage portion 1, can be manufactured of plastic material with the use of such a method as injection molding, blow molding, injection/blow molding, or the like. In this embodiment, it is manufactured of high density polyethylene with the use of blow molding. However, it may be manufactured of material other than high density polyethylene, and also, may be manufactured with the use of a method other than blow molding.

It is desired that the sealing member 3 is formed of plastic material with the use of injection molding. However, the sealing member 3 may be formed of material other than plastic material, and may be formed with the use of a method other than injection molding. As for the material for the sealing member 3, highly elastic material such as polyethylene or polypropylene is preferable. The most preferable material for the sealing member 3 is low density polyethylene. Thus, in this embodiment, low density polyethylene is selected as the material for the sealing member 3.

Incidentally, the toner supply container main structure 1A may comprise two or more sections, which are individually formed and are integrated into the toner supply container main structure 1A with the use of such means as welding, gluing, or the like.

The internal wall of the cylindrical portion of the toner supply container main structure 1A is provided with a spiral rib 1*b*, by which the toner within the toner supply container 1 is conveyed toward the toner outlet 1*a*, and is discharged therefrom, as the main structure 1A is rotated no less than once.

{Sealing Member}

The sealing member 3 is in the form of an ordinary cap, and has a sealing portion 3*a*, an engaging portion 3*b*, and a flange portion 3*c*.

The external diameter of the sealing portion 3*a* is made slightly larger than the internal diameter of the toner outlet 1*a*, and is pressed into the toner outlet 1*a* far enough for the flange portion 3*c* to come into contact with the outer edge of the toner outlet 1*a* and prevent the further insertion of the sealing portion 3*a*. The sealing member 3 unseals the toner outlet 1*a* by being moved, relative to the toner storage portion 1*a*, in the direction of the rotational axis of the toner storage portion 1.

{Recovered Developer Component Storage Portion}

Designated by the referential code 2 is the recovered developer component storage portion, which also is approximately cylindrical It is provided with an inlet 2*a* for receiving the recovered developer component. The inlet 2*a* is provided with a shutter 4, which opens or closes the inlet 2*a* as necessary.

The recovered developer component storage portion 2 is also manufactured of plastic material with the use of injection molding, blow molding, injection/blow molding, or the like. In this embodiment, it is formed of high density polyethylene with the use of blow molding. However, it may be manufactured of material other than high density polyethylene, and also, may be manufactured with the use of a method other than blow molding.

It is desired that the shutter 4 is formed of plastic material with the use of injection molding. However, the shutter 4 may be formed of material other than plastic material, and may be formed with the use of a method other than injection molding. In this embodiment, the shutter 4 is formed of impact resistant polystyrene with the use of injection molding.

Incidentally, the recovered developer component storage portion 2 may also comprise two or more sections, which are individually formed and are integrated into the recovered developer component storage portion 2 with the use of such means as welding, gluing, or the like.

{Shutter}

Referring to FIG. 1(*b*), the shutter 4 is arcuate in cross section, and its curvature matches that of the peripheral surface of the recovered developer component storage portion 2. It has a pair of guide portions 4*a*, which are U-shaped in cross section. The guide portions 4*a* constitute, one for one, the end portions of the shutter 4, in terms of the circumferential direction of the removed developer storage portion 2. On the other hand, the recovered developer component storage portion 2 is provided with a pair of ribs 2*b*, which extend in the axial direction of the recovered developer component storage portion 2 along the opposing edges of the inlet 2*a* of the recovered developer component storage portion 2. The guide portions 4*a* of the shutter 4 are engaged one for one with the pair of ribs 2*b* of the recovered developer component storage portion 2, being allowed to be slidably moved along the ribs 2*b* as necessary in the axial direction of the recovered developer component storage portion 2. The shutter 4 is also provided with a sealing member 4*b*, which is disposed in the shutter 4, on the surface facing the recovered developer component storage portion 2, in order to seal the inlet 2*a*. Further, as the toner supply container is mounted into the main assembly of an image forming apparatus, the pair of ribs 2*b* double as such portions that engage with the predetermined portions of the image forming apparatus main assembly to regulate the rotation of the recovered developer component storage portion 2.

{Toner Storage Portion and Recovered Developer Component Storage Portion}

The toner storage portion 1 and recovered developer component storage portion 2 are attached to each other, being allowed to rotate relative to each other; the recovered developer component storage portion 2 is rotationally attached to the opposite end of the toner storage portion 1, with respect to the end provided with the toner outlet 1*a*. More specifically, the opposite end of the toner storage portion 1*a* is provided with a connective boss 1*c*, which projects outward in the axial direction of the toner storage portion 1*a*, and is fitted in the central through hole of the recovered developer component storage portion 2, with the provision of a proper amount of looseness. After the fitting of the connective boss 1*c* through the central through hole of the removed developer storage portion 2, the tip of the connective boss 1*c* is increased in diameter with the use of heat or ultrasonic waves. Consequently, the recovered developer component storage portion 2 is prevented from becoming disengaged from the toner storage portion, while being allowed to be rotated as necessary. The toner supply container is mounted into the image forming apparatus main assembly so that the recovered developer component storage portion 2 is prevented from rotating relative to the image forming apparatus main assembly, as described above. Therefore, the opposite end of the toner storage portion 1, with respect to the side with the toner outlet 1*a*, is borne by the recovered developer component storage portion 2; the connective boss 1*c* of the toner storage portion 1, which is fitted through the central through hole of the recovered developer component storage portion 2, is supported by the recovered developer component storage portion 2. Thus, the opposite end of the toner storage portion 1, with respect to the end provided with the toner outlet 1*a*, in terms of the axial direction of the toner supply container, does not wobble as the toner storage portion 1 is rotated.

{Mounting of Toner Supply Container into Image Forming Apparatus}

Referring to FIG. 2, the toner supply container will be described in the state in which it is being used after being mounted into an image forming apparatus 5. As the toner supply container is inserted into the image forming apparatus main assembly from the side on which the toner outlet 1*a* is present, the engaging portion 3*b* of the sealing member 3 engages into a sealing member moving member 5*a* in the form of a collet. Then, the sealing member moving member 5*a* is closed to grip the engaging portion 3*b*, and is moved leftward in the drawing. As a result, the sealing member 3 is pulled out of the toner outlet 1*a* of the toner storage portion 1. Then, it is moved leftward a predetermined distance, and is held at the location. The movement of the sealing member moving member 5*a* maybe linked to the opening or closing of the door of the lid of the image forming apparatus, or maybe caused by operating a lever independent from the lid.

The outward surface of the lengthwise end of the toner storage portion 1, on the side where the toner outlet 1*a* is present, is provided with a plurality of projections 1*d*, as driving force receiving portions, by which the toner supply container receives rotational driving force from the image forming apparatus. Each of these projections 1*d* engages with the corresponding driving force transmitting portion of the image forming apparatus 5 so that the driving force is transmitted to the toner supply container. With the projections 1*d* of the toner storage portion 1 being engaged with the driving force transmitting portions of the image forming apparatus 5, the toner storage portion 1 is rotated to convey the toner therein toward the toner outlet 1*a*.

As the toner storage portion 1 is rotated, the toner therein is conveyed toward the toner outlet 1*a* by the spiral rib 1*b* on the internal surface of the cylindrical main structure of the toner storage portion 1, which conveys the toner in the toner storage portion 1 in the direction to move the toner away from the recovered developer component storage portion 2. Eventually, the toner in the toner storage portion 1 is discharged from the toner outlet 1*a* as the toner is continuously conveyed toward the toner outlet 1*a* by the spiral rib 1*b*.

On the other hand, as the toner supply container is inserted into the image forming apparatus main assembly, the shutter 4 of the recovered developer component storage portion 2 is engaged with the engaging portion (unshown) of the image forming apparatus main assembly, being moved, relative to the recovered developer component storage portion 2, in the axial direction of the recovered developer component storage portion 2, and exposing thereby the inlet 2*a*. It is also engaged with the unshown removed toner discharging portion, as a removed developer component discharging portion, of the image forming apparatus; the shutter 4 and inlet 2*a* of the recovered developer component storage portion 2 are engaged with the removed toner discharging portion as the rotation regulating portion, being therefore nonrotationally retained while allowing the toner storage portion 1 to be rotated. More concretely, the ribs 2*b* engage one for one with the aforementioned predetermined portions of the image forming apparatus main assembly. With the provision of the above described structural arrangement, when the toner supply container is in the state in which the toner therein can be discharged from the toner outlet 1*a* and the recovered developer component can be transferred into the recovered developer component storage portion, the removed toner discharging outlet 1*a* is immovable relative to the image forming apparatus main assembly, assuring that the removed toner is stored into the recovered developer component storage portion 2 as it is discharged from the removed toner discharging portion.

The position in the image forming apparatus, into which the toner supply container is mounted, and the method for mounting the toner supply container, do not need to be limited to the above described ones. They may be selected according to the structure of the image forming apparatus main assembly. As described above, the recovered developer component storage portion 2 has the pair of ribs 2*b* as the ribs which engage with the predetermined portions of the image forming apparatus main assembly to prevent the recovered developer component storage portion 2 from rotating relative to the image forming apparatus main assembly, when the toner storage portion 1 is rotated. These ribs 2*b* may be given a shape other than the one in this embodiment, and also may be replaced with structures other than the ribs in this embodiment; for example, grooves. Further, instead of making the ribs 2 play the role of regulating the rotation of the recovered developer component storage portion 2, the recovered developer component storage portion 2 may be provided with a single or plurality of portions, which are independent from the ribs 2*b*, and are dedicated to regulate the rotation of the recovered developer component storage portion 2. Further, as another method for preventing the recovered developer component storage portion 2 from rotating with in the image forming apparatus, the recovered developer component storage portion 2, and the recovered developer component storage portion 2 chamber in the image forming apparatus main assembly, may be given a noncircular cross section so that the engagement of the recovered developer component storage portion 2 into the recovered developer component storage portion 2 chamber in the image forming apparatus main assembly prevents the former from rotating within the latter.

{Operation of Toner Supply Container}

The movements of the various portions of the above described toner supply container, when it is operated within the image forming apparatus main assembly, will be described.

The toner storage portion 1 was filled up with 300 g of nonmagnetic single component toner, and the recovered developer component storage portion 2 (approximately 50 cc in internal volume) was completely emptied. Then, the toner supply container was mounted in the image forming apparatus. The rotational velocity of the toner storage portion 1 was set to 20 rpm. An image forming operation was carried out while rotating the toner storage portion 1, as necessary, in response to the information from the sensor (unshown) within the image forming apparatus.

The toner within the toner storage portion 1 was conveyed by the spiral rib 1*b* toward the toner outlet 1*a*, and was gradually discharged from the toner outlet 1*a*, whereas the recovered developer component storage portion 2 was gradually filled with the removed toner sent from the cleaning means of the image forming apparatus. After the formation of approximately 6,000 images, the toner within the toner storage portion 1 had been virtually exhausted (3 g of toner remained within the toner storage portion 1), whereas approximately 30 g of removed toner had been recovered into the recovered developer component storage portion 2.

The toner storage portion 1 was rotationally driven through the engagement of the aforementioned projections 1*d* with the counterparts on the image forming apparatus, and the opposite lengthwise end of the toner storage portion 1, with respect to the projections 1*d*, was confined by the recovered developer component storage portion 2. Therefore, the toner storage portion 1 did not wobble as it rotated; the toner storage portion 1 rotated without shaking from when it was full with 300 g of toner to when it had become virtually empty, generating no periodic noises and/or vibrations. The inspection of the toner storage portion 1, from which the toner had been completely exhausted, revealed no external damage.

As is evident from the above description, in the first embodiment, even as the toner storage portion 1 became substantially lighter as the toner therein was discharged, the recovered developer component storage portion 2 side of the toner supply container became heavier, compensating for the change in the inertial moment of the toner storage portion 1, on the recovered developer component storage side. Therefore, the toner supply container as a whole was prevented from wobbling as it was rotated.

{Comparative Example}

Figure 9:
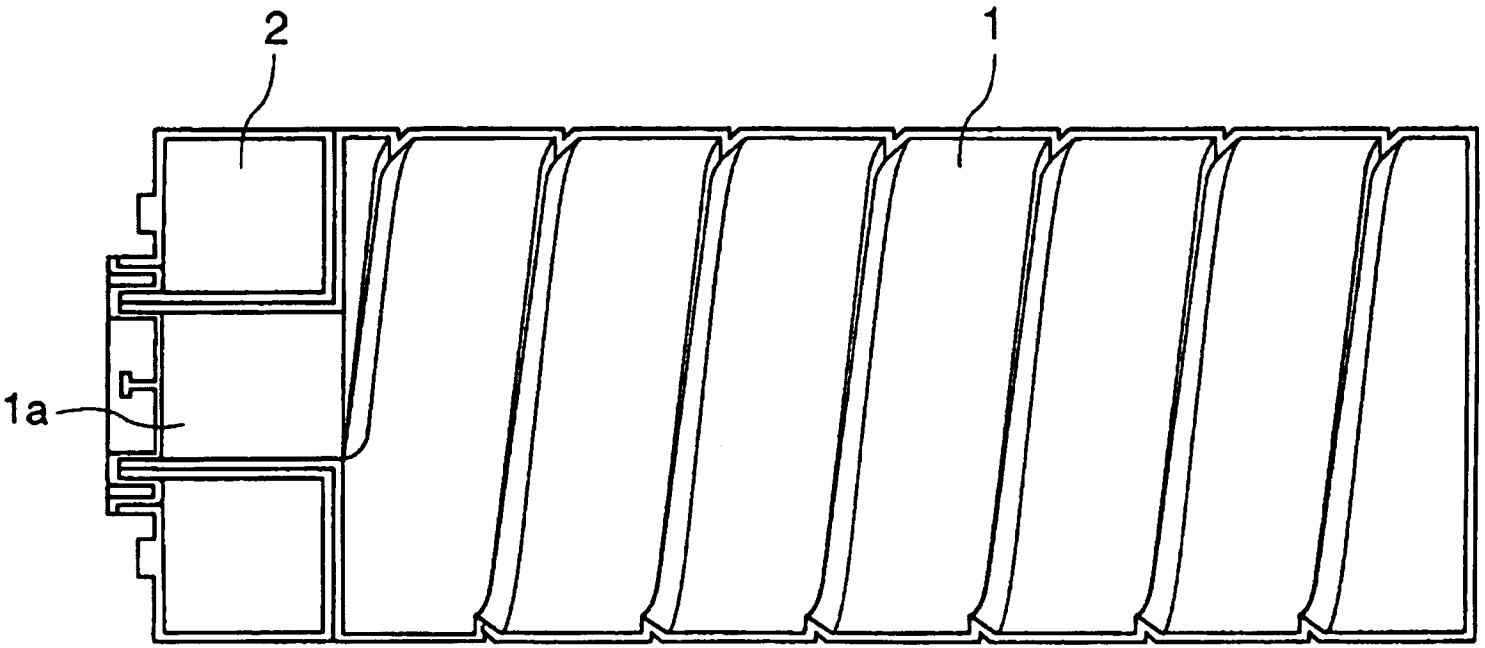
FIG. 9 PRIOR ART
FIG. 9 is a sectional view of a comparative toner supply container in accordance with the prior art.

For comparison, the toner supply container shown in FIG. 9 was subjected to the same tests as the one described above. The portions of this comparative toner supply container designated by the same referential codes as those used in FIGS. 1(*a*) and 1(*b*) supply container in the first embodiment, which have the same referential codes.

In this comparative example, the recovered developer component storage portion 2 is located on the same side as the toner outlet 1*a*, and is structured so that it rotates together with the toner storage portion 1. Otherwise this toner supply container is the identical in structure as the toner supply container in the first embodiment.

This toner supply container was subjected to the same test as that to which the toner supply container in the first embodiment was subjected. In other words, it was filled with 300 g of toner, and was mounted into the image forming apparatus main assembly. Then, it was rotated within the image forming apparatus to discharge toner therefrom. Similarly to the first embodiment, virtually the entirety of the toner in the toner storage portion 1 was discharged by the time that the approximately 6,000th image was formed. Meanwhile approximately 30 g of the removed toner was recovered into the recovered developer component storage portion 2.

At the beginning of the image forming operation, that is, when both the comparative toner supply container and the toner supply container in the first embodiment contained a large amount of toner, there was no significant difference in wobbling between the two containers. However, as the amount of the toner within the comparative toner supply container reduced below half of the original amount, the comparative toner supply container began to conspicuously wobble. Then, while the last 1,000 images were formed, the far end of the comparative toner supply container, with respect to the toner outlet 1*a*, periodically banged the image forming apparatus, generating noises. The inspection of the exterior of the comparative toner supply container after the depletion of the toner therein revealed that the exterior of the toner supply container had sustained too much circumferential damage, across the area adjacent to the lengthwise opposite end, with respect to the toner outlet 1*a*. In other words, the external appearance of the container had deteriorated too much for the container to be recycled.

The cause of the above-described excessive wobbling of the comparative toner supply container is thought to be as follows. As the cumulative amount of the toner discharged from the toner storage portion of the comparative toner supply container, and the cumulative amount of the removed toner recovered into the recovered developer component storage portion of the comparative toner supply container, gradually increased, the center of gravity of the container gradually shifted toward the toner outlet 1*a*, that is, the side from which driving force was transmitted to the container. Consequently, the intertial moment of the lengthwise end of the container opposite to the toner outlet 1*a* gradually reduced, allowing therefore the amplitude of the wobbling of this end to increase.

Figure 3B:
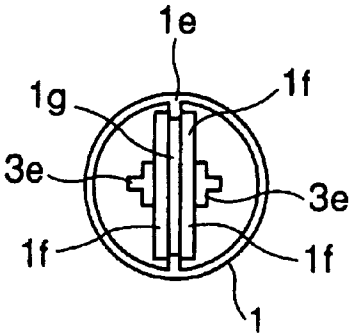
FIG. 3(*a*) is a vertical sectional view of the toner supply container in the second embodiment of the present invention at the vertical plane inclusive of the axial line of the toner supply container, and FIG. 3(*b*) is a vertical sectional view of the same toner supply container as the one in FIG. 3(*a*), at the plane A—A in FIG. 3(*a*).
Figure 3A:
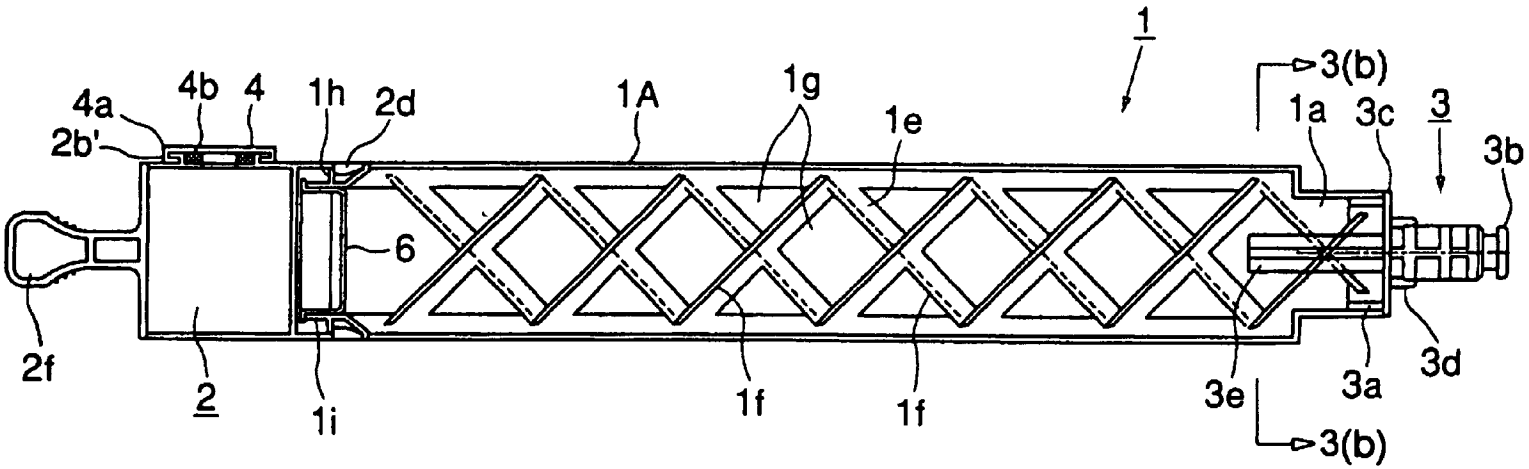
Figure 4:
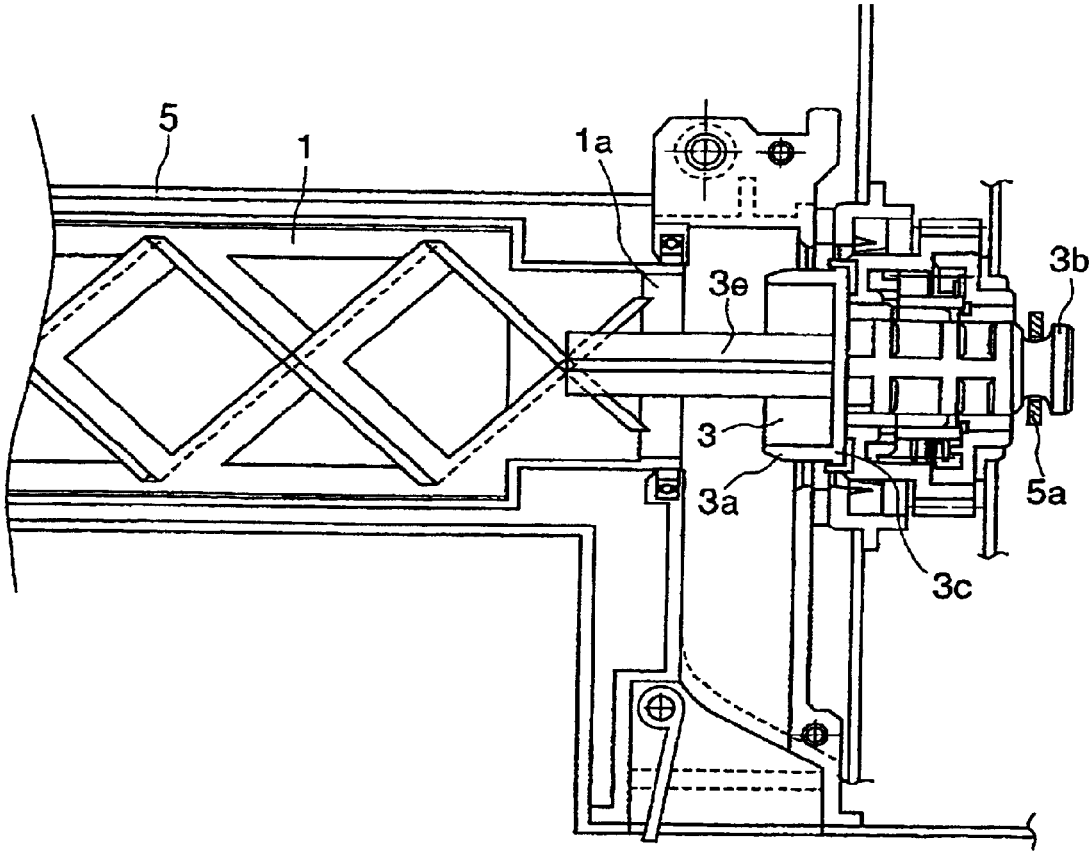
FIG. 4 is a vertical sectional view of the toner supply container in the second embodiment of the present invention, which is in the proper toner supply container position in the main assembly of an image forming apparatus.

Next, the second embodiment of the present invention will be concretely described with reference to the appended drawings. FIG. 3(*a*) is a sectional view of the toner supply container in the second embodiment of the present invention, and FIG. 4 is a sectional view of the toner supply container in the second embodiment of the prevent invention, which has been mounted in the apparatus main assembly.

Referring to FIGS. 3, 3(*a*), 3(*b*), and 4, if a component or a portion of the toner supply container in this embodiment is identical in referential code to a component or a portion of the toner supply container in FIGS. 1(*a*) and 2, which depicts the first embodiment, they are identical in function. The structural arrangements common to the first and second embodiments will not be described; only the difference in structure of the toner supply container in this embodiment from that in the first embodiment will be described.

{Toner Storage Portion}

The toner storage portion 1 in this embodiment is virtually the same in external shape as that in the first embodiment, except for the internal toner conveying member. In this embodiment, the toner storage portion 1 is provided with a partitioning plate 1*e*, which divides the internal space of the toner storage portion 1 into two chambers. The partitioning plate 1*e* is provided with a plurality of plates 1*f* and a plurality of through holes 1*g*. Each plate 1*f* is inclined at a predetermined angle relative to the axial line of the toner storage portion 1. The partitioning plate 1*e* is flat, and includes the rotational axis of the main structure 1A of the toner storage portion 1. The internal space of the toner storage portion 1 is divided into two chambers by the partitioning plate 1*e*. However, the presence of the through holes 1*g* allows the toner to move between the two chamber, to a certain degree. The inclined plates 1*f* are on both sides of the partitioning plate 1*e*, and the direction, in which the inclined plates 1*f* on one side of the partitioning plate 1*e* extend, intersects with the direction in which those on the other side extend. As shown in the drawings, the position of one end of each inclined plate 1*f* on one side of the partitioning plate 1*e* coincides with the position of one end of one of the inclined plates 1*f* on the other side. Also as shown in the drawings, portions of the partitioning plate 1*e* remaining after the formation of the through holes 1*g* through the partitioning plate 1*e* extend along and in parallel to the corresponding inclined plates 1*f*. The through holes 1*g* are rectangular or triangular. The toner is conveyed toward the toner outlet 1*a* by the rotation of the toner storage portion 1. As the toner is conveyed, it is allowed to freely move between the two sides of the partitioning plate 1*e* through the through holes 1*g*, improving the efficiency with which it is stirred. More specifically, as the toner storage portion 1 is rotated, the toner slides on the partitioning plate 1*e* and inclined plates 1*f*, being therefore conveyed toward the toner outlet 1*a*. The two inclined plates 1*f* closest to the toner outlet 1*a* extend into the toner outlet 1*a*. Therefore, as the toner storage portion 1 is rotated, the toner is discharged into the image forming apparatus through the toner outlet 1*a*.

It should be noted here that it is desired that the toner storage portion 1 is approximately cylindrical, and that its length is no less than 1.5 times, and no more than 6 times, its diameter. This structural design makes it possible to provide a toner supply container with a relatively large capacity, while reducing the amplitude of the aforementioned rotational wobbling of the toner supply container, even if the toner supply container is shaped to be most suitable for a rotary developing device for a color image forming apparatus.

The sealing member 3 is provided with a plurality of spline-like projections 3*d* for receiving driving force, and a coupling portion 3*b*. As the toner supply container is inserted into the image forming apparatus, the toner storage portion 1 is moved in its axial direction. As a result, the coupling portion 3*b* is engaged with its counterpart on the image forming apparatus main assembly, and the toner outlet 1*a* is opened. In this state, the sealing member 3 is rotatable by the rotational driving force received from the image forming apparatus through the spline-like projections 3*d*. Also in this state, the sealing member 3 and toner storage portion 1 are in connection to each other so that they are freely movable relative to each other in terms of their rotational axes direction, while being immovable relative to each other in terms of their circumferential direction.

The sealing member 3 is provided with a bifurcated projection 3*e* for transmitting rotational driving force to the aforementioned partitioning plate 1*e*. This bifurcated projection 3*e* is engaged with the partitioning plate 1*e* in a manner to sandwich the outermost two inclined plates 1*f* with its two prongs as shown in FIG. 3(*b*), allowing the sealing member 3 and partitioning plate 1*e* to freely move relative to each other in terms of the axial direction of the sealing member 3. Thus, as the sealing member 3 rotates, the partitioning plate 1*e* is rotated by the bifurcated projection 3*e*, rotating therefore the toner storage portion 1, since the partitioning plate 1*e* is attached to the internal surface of the toner storage portion 1. In other words, the toner storage portion 1 rotates together with the sealing member 3 and partitioning plate 1*e*.

{Recovered Developer Component Storage Portion}

The cross section of the recovered developer component storage portion 2 is as shown in FIG. 3. In other words, the axial line of the recovered developer component storage portion 2 coincides with that of the main structure 1A of the toner storage portion 1, and the recovered developer component storage portion 2 is in the form of a hollow cylinder, having a recovered developer component inlet 2*a*, which is on the cylindrical wall. The recovered developer component storage portion 2 is attached to the toner storage portion 1 by its snap fitting portions 2*d* so that it is not allowed to move relative to the toner storage portion 1 in terms of their axial direction, but is allowed to rotate relative to the toner storage portion 1. The snap fitting portions 2*d* are elastically deformable, and latch on the end portion of the toner storage portion 1 by sliding over the circumferential rib 1*h* of the end portion of the toner storage portion 1. Providing the recovered developer component storage portion 2 and toner storage portion 1 with the snap fitting portions 2*d* and the circumferential rib 1*h*, respectively, makes it quite simple to attach the recovered developer component storage portion 2 to the toner storage portion 1, and also makes it relatively easily to detach the recovered developer component storage portion 2 from the toner storage portion 1. As the toner storage portion 1 is rotated, the surface of the circumferential rib 1*h* facing toward the toner storage portion 1, and the surface of each snap fitting claw of the snap fitting portion 2*d* facing toward the recovered developer component storage portion 2, slide on each other.

{Toner Inlet}

The toner storage portion 1 is provided with a toner inlet 1*i*, which is cylindrical and located at the lengthwise end of the toner storage portion 1, approximately in the center. The toner inlet 1*i* is sealed with a toner inlet cap 6. The aforementioned circumferential rib 1*h* is on the peripheral surface of the cylindrical toner inlet 1*i*.

The recovered developer component storage portion 2 and toner storage portion 1 are structured so that after the snap fitting of the recovered developer component storage portion 2 with the main structure 1A of the toner storage portion 1, there will be a clearance of no more than 1 mm between the recovered developer component storage portion 2 and the circular lip of the toner inlet 1*i*. With the provision of this structural arrangement, even if the toner supply container is subjected to vibrations and/or is dropped, or even if the internal pressure of the toner storage portion 1 increases due to the increase in ambient temperature and/or decrease in ambient pressure, the toner inlet cap 6 does not become dislodged or disengaged from the toner inlet 1*i*.

{Handle Portion}

The recovered developer component storage portion 2 is provided with a handle portion 2*f*, which is integrally formed with the recovered developer component storage portion 2.

Figure 5:
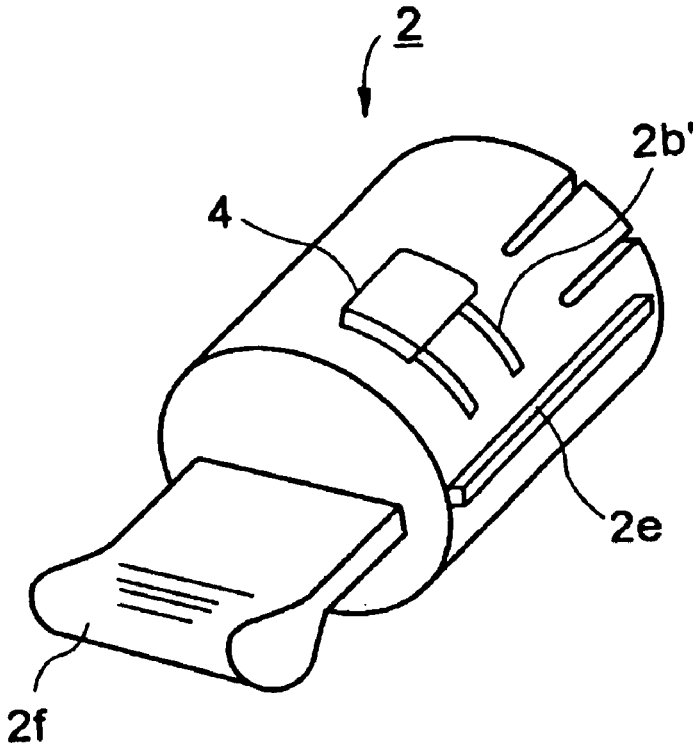
FIG. 5 is a perspective view of the recovered developer component storage portion.

The structure of the shutter 4 in this embodiment is similar to that in the first embodiment. However, in this embodiment, the direction in which the shutter 4 moves is the circumferential direction of the recovered developer component storage portion 2, instead of the axial direction of the recovered developer component storage portion 2. Thus, the ribs 2*b*' for guiding the shutter 4 are arcuate as shown in FIG. 5. In order to mount the toner supply container into the image forming apparatus 5, an operator is to insert the toner supply container into the image forming apparatus 5 from the side with the toner outlet 1*a*, by grasping the handle portion 2*f*. As the toner supply container is inserted to a predetermined position, the shutter 4 engages into the shutter catching recess in the image forming apparatus. Then, the operator is to rotate the toner supply container by grasping the handle portion 2*f*. As the toner storage portion is rotated, the recovered developer component storage portion 2 rotates a predetermined angle, with the shutter 4 locked in the shutter catching recess. As a result, the recovered developer inlet 2*a* is exposed and is connected to the unshown recovered developer component discharging portion of the image forming apparatus 5.

FIG. 5 is a perspective view of the recovered developer component storage portion 2, as seen from the handle portion side, for showing the external shape of the recovered developer component storage portion 2. The peripheral surface of the recovered developer component storage portion 2 is provided with a rib 2*e* for regulating the rotation of the recovered developer component storage portion 2. This rib 2*e* engages with its counterpart on the image forming apparatus side to regulate the angle by which the recovered developer component storage portion 2 is allowed to rotate, preventing therefore the recovered developer component storage portion 2 from rotating together with the toner storage portion 2 as the toner storage portion 1 is rotated. The movement of the toner supply container in this embodiment, in terms of the axial direction, which is caused when the toner supply container is mounted into the image forming apparatus main assembly, is the same as that in the first embodiment. In other words, with the sealing member moving member 5*a* engaged with the engaging portion 3*b*, the operator is to pull the handle portion 2*f* in the axial direction as shown in FIG. 4, to expose the toner outlet 1*a*. Obviously, the sealing member moving member 5*a* and toner storage portion 1 may be linked to the door or lever of the image forming apparatus so that the sealing member moving member 5*a* and toner storage portion 1 can be moved by moving the door or lever. The above described rib 2*e* for regulating the rotation of the recovered developer component storage portion 2 may be replaced with a groove which extends in the axial direction of the recovered developer component storage portion 2. Further, as another method for regulating the rotation of the recovered developer component storage portion 2, the recovered developer component storage portion 2, and the recovered developer component storage portion mounting chamber in the image forming apparatus main assembly, may be given a noncircular cross section.

{Image Forming Apparatus}

Figure 8:
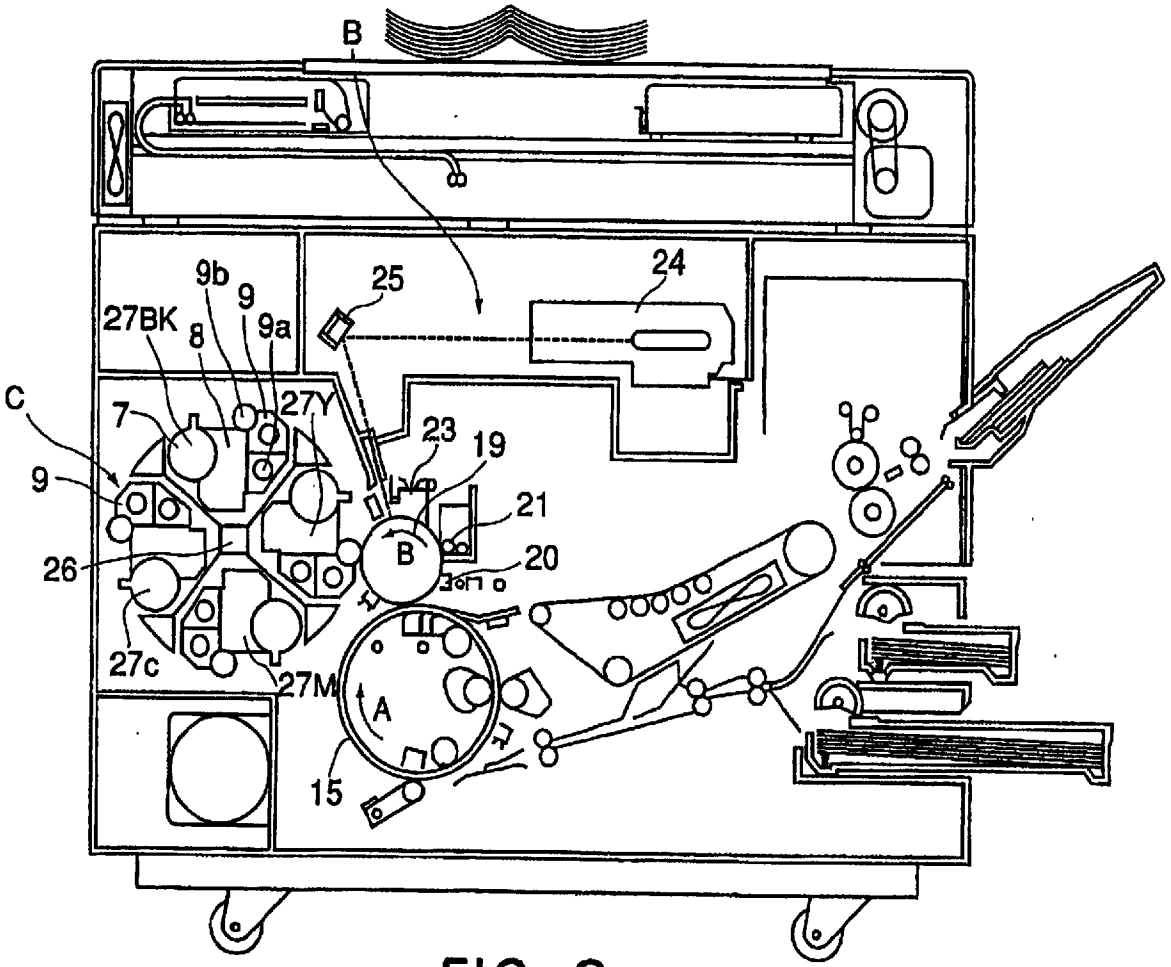
FIG. 8 is a vertical sectional view of a typical image forming apparatus compatible with the present invention.

FIG. 8 is a sectional view of an image forming apparatus in which a toner supply container in accordance with the present invention has been mounted.

To describe the structure of the latent image forming portion of the image forming apparatus, the latent image forming portion comprises: a photoconductive drum 9; a discharging device 20, a cleaning means 21, and a primary charging device 23. The photoconductive drum 9 is placed in contact with the peripheral surface of the transfer drum 15, and is enabled to be rotated in the direction indicated by an arrow mark B in the drawing. The discharging device 20, cleaning means 21, and primary charging device 23, listing in the upstream to downstream direction in terms of the rotational direction of the photoconductive drum 19, are disposed in the adjacencies of the peripheral surface of the photoconductive drum 19, in a manner to surround the peripheral surface of photoconductive drum 19. The latent image forming portion also comprises an optical image projecting means 24, such as a laser beam scanner, for forming an electrostatic latent image on the peripheral surface of the photoconductive drum 19, an optical image reflecting means 25 such as a mirror.

Adjacent to the latent image forming portion structured around the photoconductive drum 19, a rotary developing apparatus C as a developing mean is disposed, which is structured as follows. The rotary developing apparatus C comprises a rotary member 26 as a rotatable frame, which is disposed in the position in which the peripheral surface of the developing apparatus positioned in the image formation station squarely opposes the peripheral surface of the photoconductive drum 19. In the rotary member 26, four different developing apparatuses are mountable in the direction parallel to the rotational axis of the rotary member 26, being evenly distributed in terms of the circumferential direction of the rotary member 26, in order to develop an electrostatic latent image formed on the peripheral surface of the photoconductive drum 19, into a visible image. The four different developing apparatuses are yellow image developing apparatus 27Y, magenta image developing apparatus 27M, cyan image developing apparatus 27C, and black image developing apparatus 27Bk.

These four types of developing apparatuses are sequentially moved by the rotation of the rotary member 26, to a position (position of yellow image developing apparatus 27Y in FIG. 8), where they develop the corresponding electrostatic latent images into visible images. The four types of developing apparatuses are the same in structure; each developing apparatus comprises: a toner supply container 7; a toner receiving portion 8 for receiving the toner discharged from the toner supply container 7; and a developing device 9 which is supplied with toner through the toner receiving portion 8 and develops the electrostatic latent image on the peripheral surface of the photoconductive drum 19.

The toner receiving portion 8 is structured so that it receives and stores the toner discharged from the toner supply container 7, and also, supplies a predetermined amount of toner to the developing device 9 in response to the demand from the developing device 9 side. The developing device 9 contains a pair of toner conveying members 9*a*, which are made opposite in toner conveyance direction in order to evenly mix nonmagnetic toner and magnetic carrier while circulating them within the developing device 9. The developing device 9 also comprises a development sleeve 9*b*, which is rotationally supported, and in which a magnet is disposed. Thus, the carrier is adhered to the peripheral surface of the development sleeve 9*b*, forming a magnetic brush, so that the toner adhering to the carrier is supplied to the photoconductive drum 19.

In the toner storage portion 7, toner, into which carrier has been mixed at a predetermined ratio, is stored. This toner is supplied to the developing device 9 through the toner receiving portion 8. Toner itself is consumed in the developing device 9, but carrier is not consumed in principle. Therefore, as an image forming operation continues, the ratio of the carrier relative to the toner within the developing device 9 gradually increases, becoming eventually excessive. However, the developing device 9 is connected to the recovered developer component storage portion 2 by way of a carrier recovery path (unshown). Therefore, the excessive amount of the developer In the developing device 9 is discharged from the developing device 9, and is stored in the recovered developer component storage portion 2. The carrier movement is effected by the gravity; when a developing apparatus, for example, the cyan image developing apparatus 27C, is in the position shown in FIG. 8, its developing device 9 is above its toner storage portion 7 and recovered developer component storage portion 2, allowing the excessive amount of developer to be discharged by gravity. The aforementioned carrier recovery path is provided with a mechanism for preventing the recovered developer from moving backward, so that when a developing apparatus is in the position other than the position occupied by the cyan image developing apparatus 27C in FIG. 8, the carrier in the developing apparatus is not allowed to move. As for this backward flow prevention mechanism, a check value in the form of a flap may be used. Further, the carrier recovery path may be intricately bent to make it difficult for the recovered developer component to flow backward relative to the rotational direction of the rotary developing device C.

{Operation}

Next, the operation of the toner supply container in the second embodiment within the image forming apparatus will be described.

The toner storage portion 1 was filled with a mixture of 250 g of two component toner and 30 g of carrier, and the recovered developer component storage portion 2 (approximately 50 cc in internal volume) had been completely emptied. Then toner supply container was mounted into the image forming apparatus. The rotational velocity of the toner storage portion 1 was set to 20 rpm. An image forming operation was carried out while rotating the toner storage portion 1, as necessary, in response to the information from the sensor (unshown) within the image forming apparatus.

The toner within the toner storage portion 1 was conveyed by the partitioning plate 1*e* and inclined plates 1*f*, and was discharged from the toner outlet 1*a*, whereas the recovered developer component storage portion 2 was gradually filled with the removed carrier sent from the developing devices of the image forming apparatus. After the formation of approximately 10,000 images, the toner within the toner storage portion 1 had been virtually exhausted (2 g of toner remained within the toner storage portion 1), whereas approximately 30 g of removed carrier had been recovered into the recovered developer component storage portion 2.

The toner storage portion 1 is rotationally driven through the engagement of the aforementioned spline-like projections 3*e* of the sealing member 3 with the counterparts on the image forming apparatus side. The opposite lengthwise end of the toner storage portion 1, with respect to the projections 3*e*, was confined by the recovered developer component storage portion 2. Therefore, the toner storage portion 1 did not wobble as it rotated; the toner storage portion 1 rotated without shaking from when it was full with 300 g of toner to when it had become virtually empty, generating no periodic noises and/or vibrations. The inspection of the toner storage portion 1, from which the toner had been completely exhausted, revealed no external damage.

As is evident from the above description, in this embodiment, driving force was transmitted through the engagement between the sealing member 3, and the counterpart on the apparatus main assembly side, which was relatively small in diameter. In other words, the structures of the toner supply container and apparatus main assembly in this embodiment were such that the toner supply container was likely to wobble as it rotated In spite of this structural design, however, the toner supply container in this embodiment did not wobble as it rotated.

(Modified Version of Embodiment 2)

Figure 6:
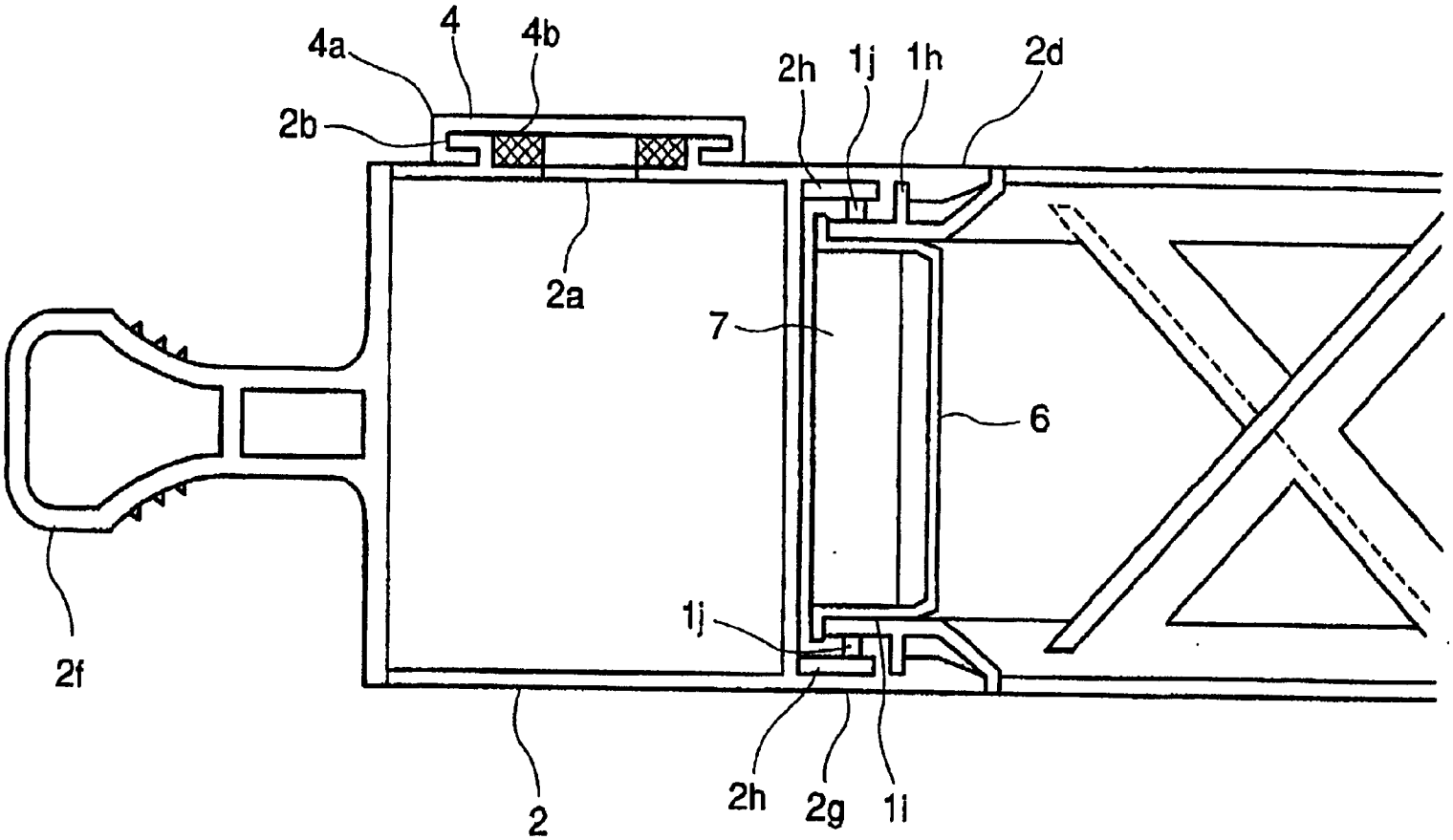
FIG. 6 is a sectional view of a modified version of the toner supply container in the second embodiment of the present invention.
Figure 7:
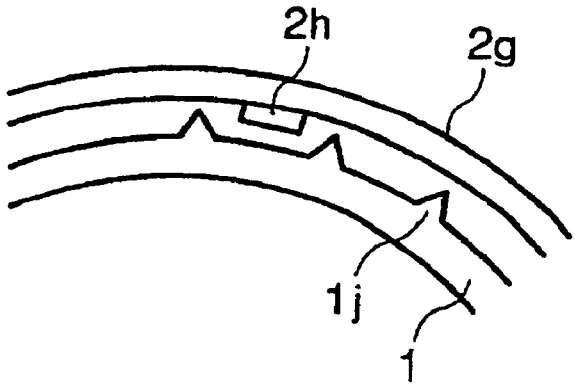
FIG. 7 is a sectional view of a vital portion of the modified version of the toner supply container in the second embodiment of the present invention, at a plane perpendicular to its axial line.

Referring to FIGS. 6 and 7, the recovered developer component storage portion 2 is provided with a plurality of projections 2*h*, each of which is located on the internal surface of the cylindrical portion 2*g*, which corresponds to the base portion of each snap fitting portion 2*d*. Further, the toner storage portion 1 is provided with a plurality of projections 1*j*, which are distributed on the peripheral surface of the toner inlet 1*i* in the circumferential direction of the toner inlet 1*i*. Each projection 1*j* and each projection 2*h* are configured so that they are elastically deformable enough to ride over one another while colliding with one another.

As the toner storage portion 1 is rotated, projections 1*j* and 2*h* collide with one another, generating impacts or vibrations, which not only reduces the amount by which toner remains unused in the toner storage portion 1, but also increases the density at which the recovered developer component is filled into the recovered developer component storage portion 2, increasing thereby the total amount of the recovered developer component which can be filled into the recovered developer component storage portion 2 Although in this embodiment, both portions 1*j* and 2*h* are in the form of a projection, the former and latter may be in the form of a projection and a recess, respectively, or vice versa, so that the former fits into the latter, or vice versa.

(Embodiment 3)

This embodiment is different from the above described second embodiment in that the nonmagnetic toner supply is stored in the toner storage portion, without the presence of the magnetic carrier, and also in that in the recovered developer component storage portion, the waste carrier and the toner adhering to the waste carrier are collected To describe this embodiment with reference to FIG. 6, a magnet 7 is disposed within a toner inlet cap 6, so that it will be placed immediately next to the recovered developer component storage portion 2 as the recovered developer component storage portion 2 is snap fitted with the toner storage portion 1. With the presence of the magnet 7 immediately next to the recovered developer component storage portion 2, as the toner storage portion 1 is rotated, the recovered developer component in the recovered developer component storage portion 2 is stirred by the magnetic force from the magnet 7.

Since the recovered developer component in the recovered developer component storage portion 2 is better stirred by the magnetic force, the density at which the recovered developer component is filled into the recovered developer component storage portion 2 is increased, increasing thereby the total amount of the recovered developer component which can be filled into the recovered developer component storage portion 2.

The effects of the above described embodiments can be listed as follows.

Even though the toner storage portion becomes gradually lighter due to the discharging of the toner therefrom, the recovered developer component storage portion becomes gradually heavier due to the accumulation of the recovered developer component therein, compensating therefore for the loss of the inertial moment of the toner storage portion caused by the weight loss of the toner storage portion, preventing therefore the rotational wobbling of the toner supply container as a whole.

In order to prevent the recovered developer component storage portion from rotating with the toner storage portion, the recovered developer component storage portion is provided with a single or plurality of projections, or grooves, which engage with the counterparts of the image forming apparatus main assembly, or the recovered developer component storage portion, and the portion of the image forming apparatus, which engages with the recovered developer component storage portion, are given such a cross section that prevents the recovered developer component storage portion from rotating in the image forming apparatus main assembly. Therefore, it is possible to keep the attitude of the recovered developer component storage portion stable, ensuring that the recovered developer component inlet of the recovered developer component storage portion remains perfectly connected to the counterpart on the image forming apparatus side. Therefore, the recovered developer component does not leak.

The toner in the toner storage portion is conveyed in the direction to move away from the recovered developer component storage portion. Therefore, the weight of the toner supply container as a whole is distributed to the lengthwise end portions of the toner supply container, that is, the adjacencies of the lengthwise end of the toner storage portion opposite to the recovered developer component storage portion, and the recovered developer component storage portion; in other words, the weight of the toner supply container is shifted to the two ends of the toner supply container in terms of the direction of its rotational axis. Therefore, the rotational wobbling of the toner supply container is minimized.

The toner supply container is provided with the sealing member for sealing or unsealing the toner outlet of the toner storage portion, and the driving force for rotating the toner storage portion is transmitted to the toner storage portion through this sealing member, eliminating the space otherwise necessary for a driving force receiving portion. Therefore, it is possible to make the toner supply container compact, and also to afford more latitude in the design of the toner supply container.

The toner outlet of the toner storage portion is virtually cylindrical, and is located on the end wall, in the center, on the side from which the rotational driving force is received by the toner storage portion. The sealing member, which is positioned so that its axial line coincides with the rotational axis of the toner storage portion, is moved in the rotational axis direction of the toner storage portion, relative to the toner storage portion, to be pressed into the toner outlet to seal the toner outlet, or pulled out of the toner outlet to unseal the toner outlet. Thus, the axial line of the toner outlet coincides with the rotational axis of the toner storage portion, and the toner outlet remains stationary while the sealing member can be repeatedly moved relative to the toner outlet to seal or unseal the toner outlet. Therefore, when toner is supplied or when the empty toner supply container is removed from the image forming apparatus main assembly, it does not occur that the adjacencies of the toner outlet are soiled by the scattered toner.

The sealing member and toner storage portion are engaged so that they are allowed to move relative to each other in terms of their rotational axes, but not in terms of their circumferential direction. Therefore, the sealing member is enabled to transmit the rotational driving force to the toner storage portion at the same time as it seals or unseals the toner storage portion.

The recovered developer component storage portion is provided with a handle portion, which is integrally formed with the recovered developer component storage portion. Therefore, the recovered developer component storage portion, which is basically nonrotational relative to the image forming apparatus main assembly, can be easily aligned with the image forming apparatus main assembly when mounting the toner supply container into the image forming apparatus main assembly.

The recovered developer component storage portion is provided with a plurality of snap fitting claws, by which the recovered developer component storage portion is snap fitted with the toner storage portion so that the two storage portions are allowed to rotate relative to each other, with the snap fitting claws and the counterparts of the toner storage portion sliding on each other. Therefore, the recovered developer component storage portion can be easily engaged with, or disengaged from, the toner storage portion, simplifying the assembly of the toner supply container, as well as the remanufacturing of the recovered used toner supply containers and/or reprocessing of the recovered developer component.

The recovered developer component storage portion is provided with a plurality of projections, which are enabled to ride over the counterparts of the toner storage portion, while interfering with them, as the two storage portions are moved relative to each other; the toner storage portion is provided with a plurality of projections which are enabled to ride over the counterparts of the recovered developer component storage portion, while interfering with them, as the two storage portions are moved relative to each other, so that impacts and/or vibrations are generated as the toner storage portion is rotated. Therefore, not only is the amount by which the toner remains undischarged minimized, but also the density at which the recovered developer component is packed into the recovered developer component storage portion is maximized, maximizing therefore the total amount by which the recovered developer is filled into the recovered developer component storage portion.

The portion of the toner storage portion, which is immediately next to the recovered developer component storage portion, is provided with a magnet, so that as the toner storage portion is rotated, the recovered developer component (recovered magnetic carrier, or magnetic toner) within the recovered developer component storage portion is effectively stirred by the magnetic force of the magnet. Therefore, the density at which the recovered developer component is packed into the recovered developer component storage portion, is maximized, maximizing therefore the total amount by which the recovered developer component is stored in the recovered developer component storage portion.

One of the lengthwise end walls of the toner storage portion is provided with a toner inlet, which is sealed with a cap, and the recovered developer component storage portion is structured and disposed to cover this cap of the toner inlet. Therefore, even if the cap is subjected to such force that is generated as the toner supply container is subjected to transportation stresses resulting from the falls, vibrations, and the like, and/or even if the internal pressure of the toner storage portion increases due to the environmental stresses resulting from increase in ambient temperature, decrease in atmospheric pressure, and the like, the recovered developer component storage portion plays the role of preventing the cap from being disengaged from the toner inlet. Therefore, the problem that the cap comes off and allows the toner to leak does not occur. In addition, the cap is prevented from being accidentally removed by a user.

While the invention has been described with reference to the structures disclosed herein, it is not confined to the details set forth and this application is intended to cover such modifications or changes as may come within the purposes of the improvements or the scope of the following claims.

What is claimed is:

1. A cartridge detachably mountable to an image forming apparatus, said cartridge comprising:

a first container for containing a developer to be supplied into the image forming apparatus;

a developer discharge opening provided at one longitudinal end side of said first container;

a drive input portion, provided at the one longitudinal end side, for receiving a driving force for rotating said first container from the image forming apparatus when the developer is fed toward said discharge opening; and a second container for accommodating a developer collected from the image forming apparatus, wherein said first container is rotatably supported, at the other longitudinal end side thereof, by said second container, which is unrotatably engageable with said image forming apparatus.

2. A cartridge according to claim 1, wherein when said first container rotates, a substantial rotational center of said first container is supported by said second container.

3. A cartridge according to claim 1 or 2, wherein said first container includes a projection, which is projected toward said first container, and which is supported by said second container.

4. A cartridge according to claim 3, wherein said projection includes a limiting portion for limiting movement of said first container in a longitudinal direction of said first container.

5. A cartridge according to claim 4, wherein said limiting portion includes a snap-fit structure for snap-fitting with said second container.

6. A cartridge according to claim 3, wherein said projection is hollow to accommodate the developer.

7. A cartridge according to claim 1, further comprising a vibrating portion for vibrating said first container and said second container with rotation of said first container.

8. A cartridge according to claim 1, wherein said first container has an opening, at the other longitudinal end side of said first container, for permitting said first container to be filled with a developer, and wherein said second container is provided so as to cover said opening.

9. A cartridge according to claim 8, further comprising a cap for capping and opening, wherein said second container is effective to prevent said cap from disengaging.

10. A cartridge according to claim 1, wherein the developer to be supplied and the collected developer contain toner and carrier particles.

11. A cartridge according to claim 1, wherein said second container is provided with a receiving opening for receiving the collected developer, and wherein the receiving opening is stationary when the developer is collected.

12. A cartridge detachably mountable to an image forming apparatus, said cartridge comprising:

a first container for containing a developer to be supplied into the image forming apparatus;

a filling opening, provided at one longitudinal end side of said first container, for permitting said first container to be filled with the developer; and a second container for accommodating a developer collected from the image forming apparatus;

wherein said second container is disposed so as to cover said filling opening.

13. A cartridge according to claim 12, further comprising a cap for capping said filling opening, wherein said second container is effective to prevent said cap from disengaging.

14. A cartridge detachably mountable to an image forming apparatus, comprising:

a first container for accommodating a developer to be supplied into the image forming apparatus by rotation thereof;

a second container for accommodating a developer collected from the image forming apparatus; and a snap-fit structure for separably connecting said first container to said second container, wherein said snap-fit structure permits relative rotation between said first container and said second-container, wherein said first container and said second container are detachably mountable to the image forming apparatus while said first container and said second container are connected to each other by said snap-fit structure.

15. A cartridge according to claim 14, wherein said snap-fit structure is provided with a vibrating portion for vibrating said second container, which is fixed substantially non-rotatably to the image forming apparatus.

16. A cartridge according to claim 14, wherein said snap-fit structure includes a projection and a recess, which are engageable with each other, and wherein one of said projection and said recess is integrally provided with one of said first container and said second container and the other of said projection and said recess is integrally provided with the other of said first container and said second container.

17. A cartridge detachably mountable to an image forming apparatus, comprising:

a first container for at least accommodating non-magnetic toner to be supplied to the image forming apparatus;

a second container for at least accommodating magnetic carrier collected from the image forming appparatus; and a connecting portion for connecting said first container to said second container so as to permit rotation of said first container relative to said second container, which is fixed substantially non-rotatably to the image forming apparatus, wherein said first container and said second container are detachably mountable to the image forming apparatus while said first container and said second container are connected to each other by said connecting portion, wherein said connecting portion includes a vibrating portion for vibrating said second container with rotation of said first container, second said vibrating portion includes abutment portions on said first container and said second container, respectively, and wherein said abutment portions are abuttable to each other when said first container rotates relative to said second container.

18. A cartridge detachably mountable to an image forming apparatus, said cartridge comprising:

a developer supply container for supplying a developer to the image forming apparatus by rotation thereof;

a collecting container for containing magnetic particles collected from said image forming apparatus, wherein said developer supply container is rotatable relative to said collecting container non-rotatably set in the image forming apparatus, and wherein said developer supply container is provided adjacent to said collecting container and includes a magnet that effectively stirs said magnetic particles in said collecting container.

* * * * *

UNITED STATES PATENT AND TRADEMARK OFFICE

CERTIFICATE OF CORRECTION

PATENT NO. : 7,079,788 B2
APPLICATION NO. : 10/028668
DATED : July 18, 2006
INVENTOR(S) : Yutaka Ban et al.

It is certified that error appears in the above-identified patent and that said Letters Patent is hereby corrected as shown below:

ON THE TITLE PAGE:

At Item (56), References Cited, Foreign Patent Documents, "JP 04001690 A * 1/1992" should read --JP 4-1690 1/1992--.

COLUMN 1:
Line 11, "Image" should read --image--.
Line 49, "two component" should read --two-component--.

COLUMN 2:
Line 23, "above described" should read --above-described--.
Line 64, "above described" should read --above-described--.

COLUMN 5:
Line 52, "cylindrical" should read --cylindrical.--.

COLUMN 7:
Line 65, "above described" should read --above-described--.

COLUMN 8:
Line 11, "above described" should read --above-described--.
Line 31, "with in" should read --within--.

COLUMN 13:
Line 7, "above described" should read --above-described--.

COLUMN 14:
Line 31, "In" should read --in--.

COLUMN 15:
Line 30, "rotated" should read --rotated.--.
Line 53, "portion 2" should read --portion 2.--.
Line 59, "above described" should read --above-described--.

COLUMN 16:
Line 17, "above described" should read --above-described--.

COLUMN 19:
Line 2, "has an opening," should read --includes a filling opening--.
Line 8, "and opening," should read --said filling opening,--.
Line 43, "second-container." should read --second container.--.

UNITED STATES PATENT AND TRADEMARK OFFICE

CERTIFICATE OF CORRECTION

PATENT NO. : 7,079,788 B2
APPLICATION NO. : 10/028668
DATED : July 18, 2006
INVENTOR(S) : Yutaka Ban et al.

It is certified that error appears in the above-identified patent and that said Letters Patent is hereby corrected as shown below:

COLUMN 20:

Line 31, "second" should read --wherein--.

Signed and Sealed this

Twenty-second Day of May, 2007

JON W. DUDAS
*Director of the United States Patent and Trademark Office*